United States Patent [19]

Kowalik

[11] Patent Number: 4,459,913

[45] Date of Patent: Jul. 17, 1984

[54] ADJUSTMENT STRUCTURE FOR MASTER HOLDER

[75] Inventor: Matthew F. Kowalik, Wheeling, Ill.

[73] Assignee: A. B. Dick Company, Chicago, Ill.

[21] Appl. No.: 408,765

[22] Filed: Aug. 17, 1982

[51] Int. Cl.[3] ..... B41F 1/28

[52] U.S. Cl. ..... 101/415.1; 101/409

[58] Field of Search ..... 101/415.1, 409

[56] References Cited

U.S. PATENT DOCUMENTS

| | | | |
|---|---|---|---|
| 2,123,997 | 7/1938 | Jirousek | 101/415.1 |
| 2,737,887 | 3/1956 | Gericke | 101/415.1 |
| 2,973,710 | 3/1961 | Hantscho | 101/415.1 |
| 3,191,532 | 6/1965 | Hermach et al. | 101/415.1 |
| 4,018,158 | 4/1977 | Borneman | 101/415.1 X |

FOREIGN PATENT DOCUMENTS

| | | | |
|---|---|---|---|
| 1082639 | 9/1967 | United Kingdom | 101/415.1 |
| 1183583 | 3/1970 | United Kingdom | 101/415.1 |
| 1231188 | 5/1971 | United Kingdom | 101/415.1 |
| 2074096 | 10/1981 | United Kingdom | 101/415.1 |

OTHER PUBLICATIONS

*Operating Instructions Models* 350/360, (p. 8), published Aug. 6, 1973 by A. B. Dick Company, printed by Argus Press, 7440 Natchez Avenue, Niles, Illinois, Copyright Aa 489606, registered Dec. 18, 1973.

*A. B. Dick Company Parts Catalog,* Model 1-3662, Universal Head Clamp and Model 1-3663 Short-Bite Universal Head Clamp, published Apr. 15, 1964, printed by A. B. Dick Company, Copyright Registration No. Aa 689576, Apr. 22, 1964.

*Primary Examiner*—Edgar S. Burr

*Assistant Examiner*—John A. Weresh

*Attorney, Agent, or Firm*—Peter S. Lucyshyn

[57] ABSTRACT

A master sheet carrier which has a bar capable of holding the master sheet by clamping an end thereof, the bar being mounted on a mounting beam which is movable angularly and transversely with respect to the direction of movement of the master carrier, without requiring removal of the clamped master end, by manual operation of thumb nuts located to one side of the surface of the carrier over which the master is laid.

1 Claim, 9 Drawing Figures

ADJUSTMENT STRUCTURE FOR MASTER HOLDER

BACKGROUND OF THE INVENTION

There are different duplicating processes which depend on moving a master or plate in a predetermined direction of travel to transfer an image from the master to copy paper stock. One such duplicating process is the offset duplicating process. Commonly, a master carrying assembly, for example, a cylinder, serves to hold the master or plate during the cyclical operation that effects transfer of images to the copy paper. The head end of the master is held securely by the master carrying assembly. The holding mechanism may take various forms including one form which clamps a master end. Another form of the master holding or securing mechanism may have a series of pins projecting from a bar extending generally parallel to the cylinder axis and mounted adjacent the cylinder periphery. The master end holding means, whatever its form may be, is preferably adjustable, both angularly and perpendicularly, relative to the direction of movement of the master carrying assembly to suitably align the print on the copy sheet. This is because the orientation of the image on the master, for example the lines of print across the width of the master, are not necessarily precisely related to the master end or to the perforations in the master, which are the portions of the master engaged by the master holding means. To explain further, a clamp commonly has a straight edge against which one end of the master is pressed before the master is gripped to align the master relative to the carrying assembly. If the end of the master is not parallel to the lines of print, then the duplicated image will be skewed on the copy sheet. In the other holding means referred to, a pin bar is provided to engage the perforations. It is understandable how an image may be misaligned on a copy sheet if the perforations or pin holes along the edge of a master are not aligned properly relative to the image on the master.

Prior art devices have structures which adjust the alignment of the pin bars. One example of such structure is a thumb screw positioned to one side of a center pivot for the beam which connects the pin bar to the frame of the master carrying assembly. The thumb screw has posts on either side extending in opposite directions which have left-hand and right-hand threads, respectively. One post is threaded in a fixed support and the other is threaded in a support which is a part of the pivotable beam. Turning of the screw draws one side of the beam toward the fixed support or forces that side of the beam away from the fixed support, depending on which direction the thumb screw is turned, thereby pivoting the beam and the pin bar with it. It is in this way that the master is aligned. Such a structure is adapted for installation on the A. B. Dick Company (assignee of the present invention) Model 360 offset press.

There is, however, no structure for repositioning the clamp which grips the straightedge master end. The straightedge master must be separated from the holding mechanism, repositioned, and then reclamped. Accordingly, the operator, when adjusting, must guess whether a predetermined amount of master end holding means adjustment will be suitable once the master is inserted. Furthermore, once the master end has been inserted and clamped it is creased and deformed. That weakens the master in that region and limits the number of times the master can be repositioned relative to the master carrier surface. In general, these prior art structures are cumbersome to operate, do not provide for angular adjustment of both the pin bar and straightedge, and tend to become fouled because of the location in close proximity to where ink and chemicals are used.

SUMMARY OF THE INVENTION

According to the present invention there is disclosed a master carrier having a surface overlaid by a master sheet and which carrier has an assembly for clamping the straightedge end of the master, such clamping assembly is provided with an improved mechanism for adjusting the position of the master sheet relative to the overlaid carrier surface without requiring the master sheet to be removed and, therefore, it permits practially unlimited opportunity to reposition the master relative to that surface.

Accordingly, it is an object of the present invention to provide an improved master clamping mechanism which is relatively easy to operate, which permits angular adjustment of a universal master clamp, and which is reliable.

It is a more specific object of the present invention to provide an improved adjusting means for a master clamping mechanism which holds position once selected much better than prior art structures.

It is an overall further object of the present invention to provide a master holding mechanism which is economical to manufacture.

DETAILED DESCRIPTION

Figure 1:
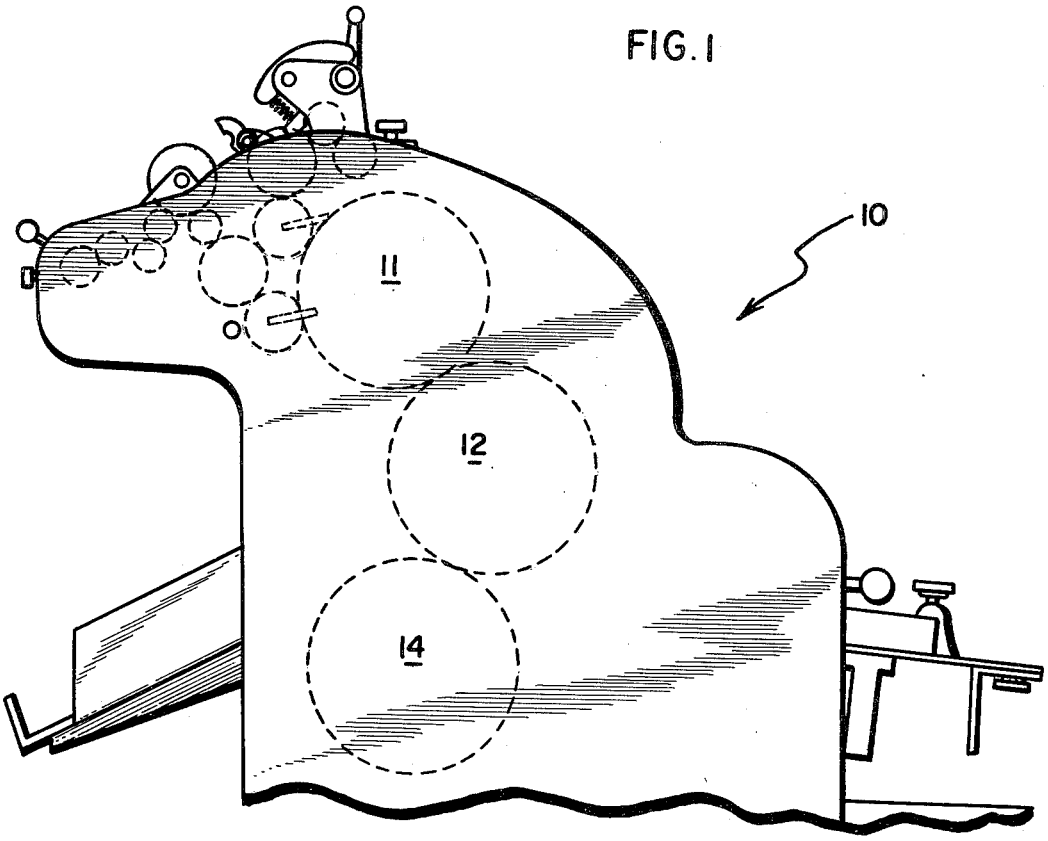
FIG. 1 is a schematic, side elevation of a portion of an offset machine showing the relative position of a master cylinder.
Figure 7:
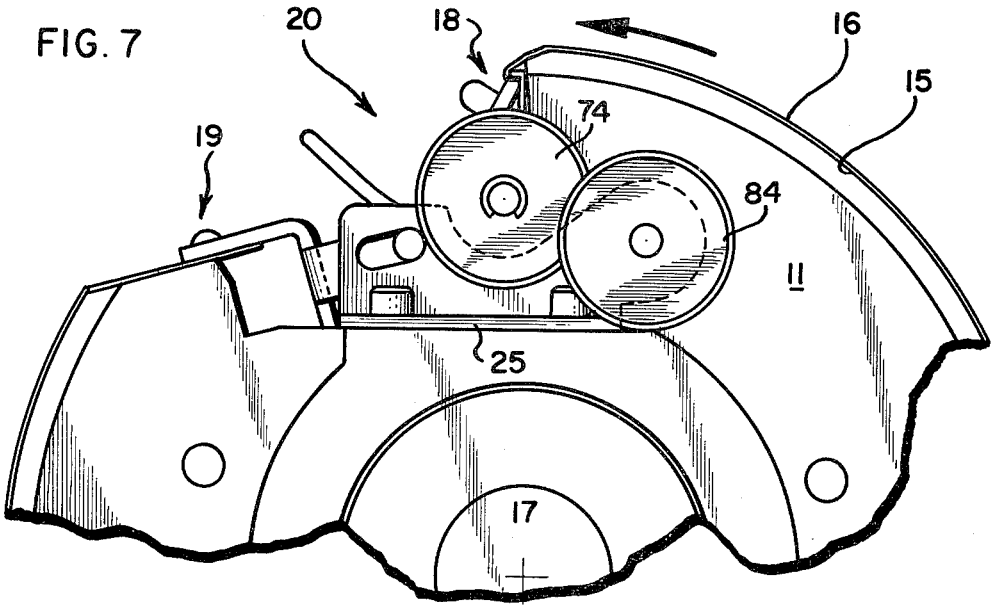
FIG. 7 is a side elevation of a portion of the right side of the cylinder of FIG. 2.

Referring to FIG. 1, an exemplary offset duplicating machine 10 is shown schematically as one instance for application of the present invention. The duplicating machine 10 shown has a master cylinder 11 operative to transfer an image to a blanket cylinder 12 which transfers the ink image to copy sheets pressed against the blanket by an impression clyinder 14. The master cylinder 11 functions as a master carrier having a peripheral surface 15 (See Figs. 3 and 7). A master sheet 16 is laid circumferentially over the surface 15 and held on the master cylinder by a head end attaching or holding assembly 18 and a tail end holding assembly 19. The head end holding assembly and tail end holding assembly are located in an open section 20 of the master sheet carrying cylinder 11. Each is mounted so as to be recessed with respect to the outer circumference of the cylinder and not interfere with the blanket cylinder during rotational engagement of the master cylinder and the blanket cylinder. The master cylinder rotates in a counter clockwise direction as shown by an arrow in the aforementioned Figures.

Figure 2:
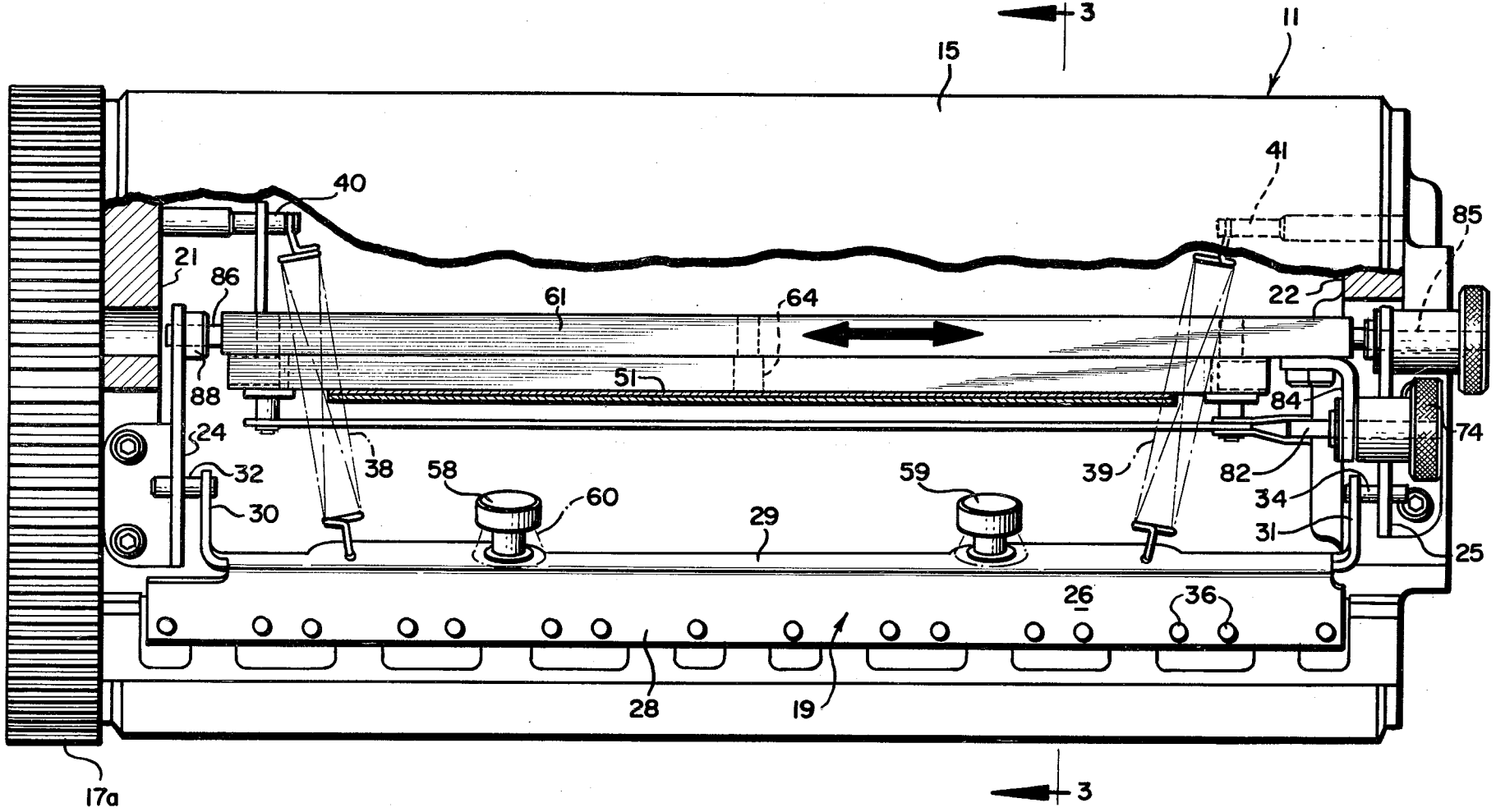
FIG. 2 is a top view of an exemplary master carrier cylinder embodying the present invention.
Figure 3:
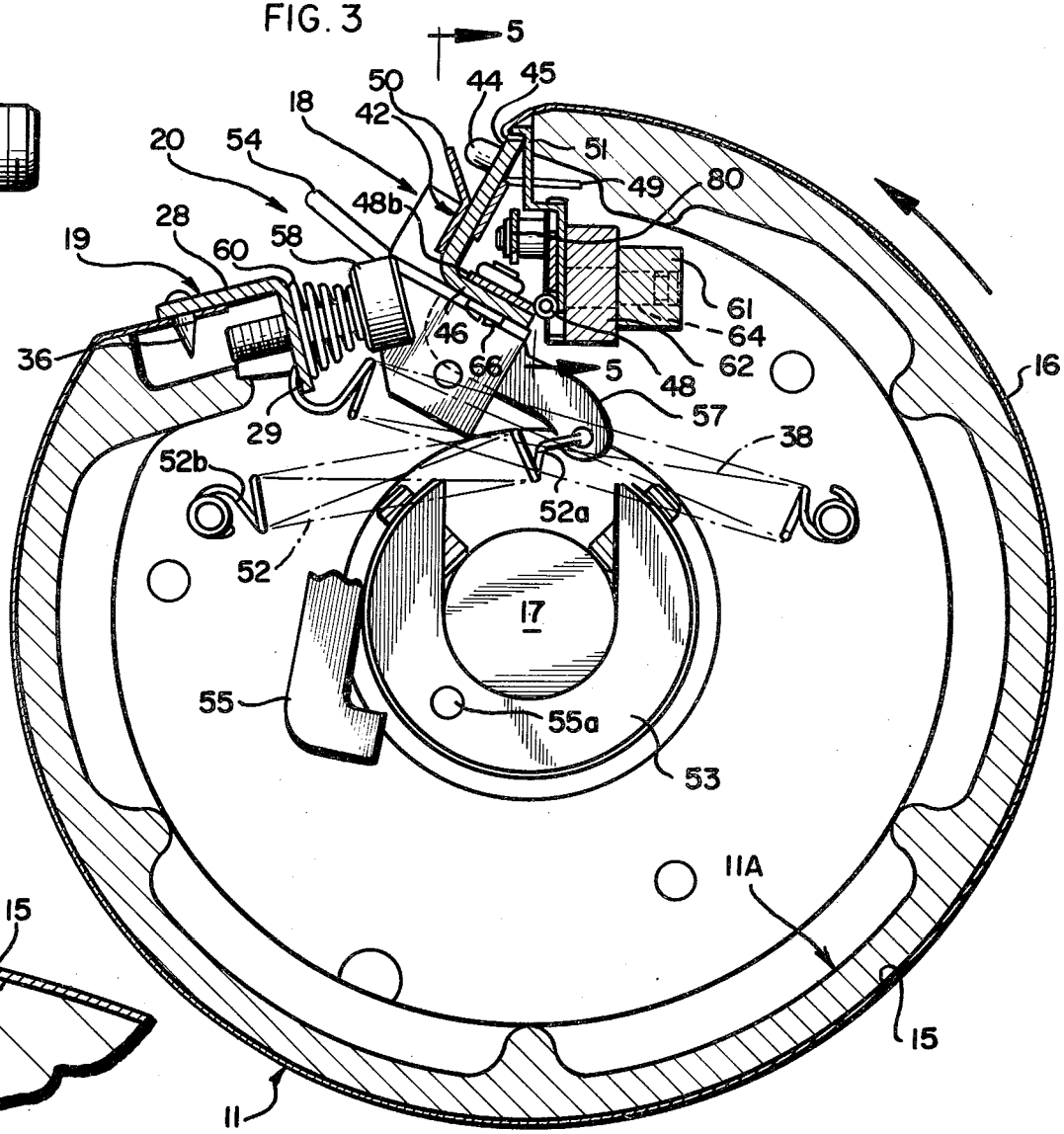
FIG. 3 is a section of the cylinder taken along lines 3—3 in FIG. 2.
Figure 8:
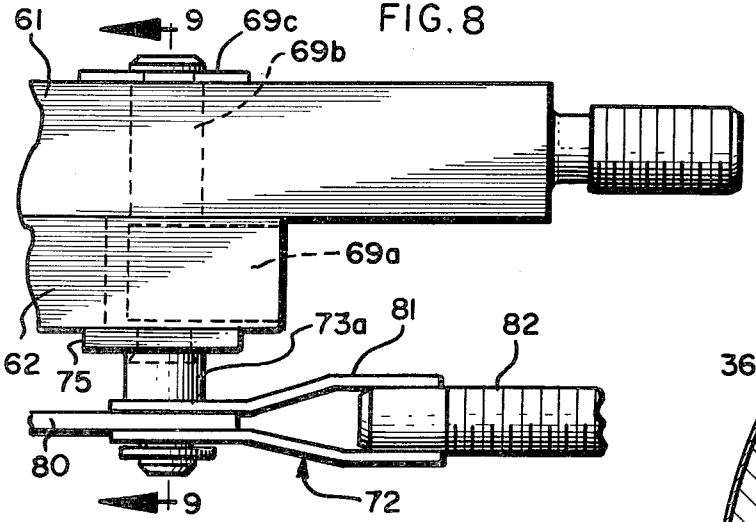
FIG. 8 is a plan view of a portion of the adjusting mechanism shown in FIGS. 6 and 7.
Figure 9:
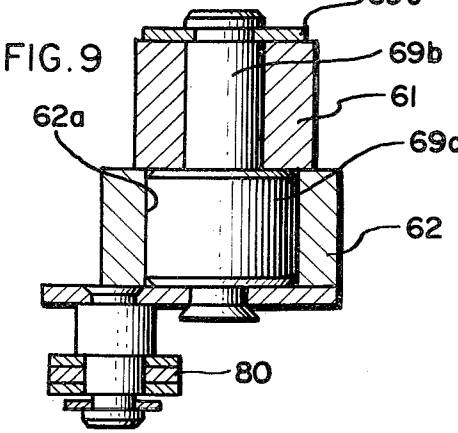
FIG. 9 is a section taken along lines 9—9 in FIG. 8.
Figure 4:
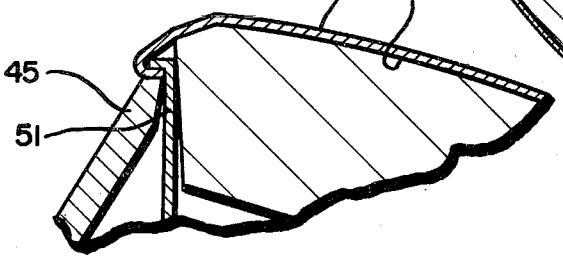
FIG. 4 is an enlarged section showing the details of the structure for gripping the master end.

Describing the cylinder 11 in more detail, a master cylinder frame 11*a* (See FIG. 3) includes an axially extending cylinder portion 11*b* (See FIG. 5) and individual bell sections 21, 22, respectively, set into the opposite ends thereof. A shaft 17 comprises the axis on which the cylinder is rotatably carried. A gear 17*a* constitutes part of bell section 21 and transmits drive to the shaft 17. The structure of cylinder 11 also includes a mounting bracket 24 which is secured to bell section 21 and another mounting bracket 25 which is secured to the other bell section 22 for supporting the tail end clamp assembly 19. Describing the tail end holding assembly 19 and its support in more detail, the latter includes a plate 26 which extends generally axially of the cylinder 11 and is formed to have a right angle cross section with a plate section 28 disposed along the periphery of the cylinder 11 and another plate section 29 extending toward the axis of cylinder 11. The plate section 29 is provided with transverse legs 30, 31 at the opposite ends thereof for carrying pivot pins 32, 34 (See FIG. 2). The latter are fitted into apertures in the respective support brackets 24 and 25. For engaging and holding the tail end of the master sheet, the plate section 28 is provided with a plurality of spiked posts 36 which have pointed sections extending generally toward the axis of the master cylinder 11. The tail holding plate section 28 and posts 36 are biased toward the inside of the cylinder to hold the master tail end by the action of springs 38 and 39. As shown in FIG. 3, the springs apply a counterclockwise rotation to the plate 28. Referring to FIG. 2 the springs 38 and 39 have one end hooked into suitable apertures in plate portion 29 and their opposite ends are hooked on respective anchor posts 40 and 41.

Turning to the assembly 18 for holding the head end of the master, the preferred embodiment shows a universal master holding assembly which can either grip the master head-end by clamping it or retain the master head-end by engaging perforations in it. Describing the assembly 18 and its support in more detail, it includes a bar 42 of a generally right angle cross section with a plate portion 45 adapted to engage and grip the master end and a foot portion 46 connected to a hinge 48, which pivotably supports the bar 42.

To guide the head end of the master 16 as it is fitted into engagement with the assembly 18, a pair of stops 49 and 50 are provided. The stop 49 is engaged when the master sheet edge is inserted between an anvil plate 51 and the clamp plate 45 after the latter is pivoted open. The master clamp plate 45 is normally biased against the anvil plate 51 by action of a pair of springs, one of which 52 is shown. One end 52*a* of the spring 52 is connected to a leg 57 depending from bar 42 and another end 52*b* is anchored to a stake projecting from bell end 21. Manual separation of the clamping plate 42 is accomplished by pressing on a tab 54 and pushing counterclockwise about hinge 48 against the action of spring 52 as shown in FIG. 3. The clamp is capable of opening by itself at a predetermined rotative position of the cylinder 11, if a movable finger mechanism 55 is released so it can engage a pin 55*a* located on a U-shaped collar 53 mounted on the cylinder support shaft 17. The finger mechanism 55 is made operative by sliding axially a lockout tab 56 (See FIG. 6). The finger mechanism 55 swings by gravity toward the pin 55*a* and hooks it. It remains hooked for a predetermined sector of the cylinder rotation and then releases when gravity causes the finger mechanism to swing away from the pin 55*a*. When the finger mechanism catches the pin 55, it pulls the clamp plate 45 counter clockwise, as viewed in FIG. 3, about hinge 48 against the spring bias. When the finger mechanism unhooks the clamp plate 45 returns to engage the anvil 51. Ordinarily, the self-opening clamp is adjusted to open the clamp assembly 18 when the latter moves into a predetermined region near the top of a revolution of the master cylinder. The other stop 50 is used as a guide for initially aligning the master end of a perforated master as it is fitted onto the posts 44.

Following initial attachment of the master head end so that it is secured to the head assembly 18, the master sheet 16 is wrapped around or laid circumferentially over the cylinder surface 15 so that the tail end of the master is brought into proximity with the tail holding assembly 19. As described previously, the tail holding assembly has a plate 26 which is manually pivoted to permit the master sheet to be brought up and under the plate section 28 so the spiked posts can engage the end of the master. In order to permit appropriate tightening of the master about the circumferential surface of the master cylinder, the tail holding assembly 19 is provided with a pair of tension adjusting thumb screws 58 and 59 (See FIGS. 2 and 3). The thumb screws 58 and 59 are threaded into plate portion 29 with the ends thereof suitably engaging the frame 11*a* of the cylinder 11. As can best be observed in FIG. 3, turning of the screws moves the plate portion 29 and therewith plate portion 28 and posts 36 in a generally upward direction so as to draw the master sheet 16 about the cylinder surface 15. By providing two screws 58 and 59, the tension can be adjusted suitably over the width of the master cylinder 11. Interposed between the thumb screw head and the plate 29 are springs (one of which 60 is shown in FIG. 3) to maintain tension on the thumb screws and prevent turning once they are set.

Figure 5:
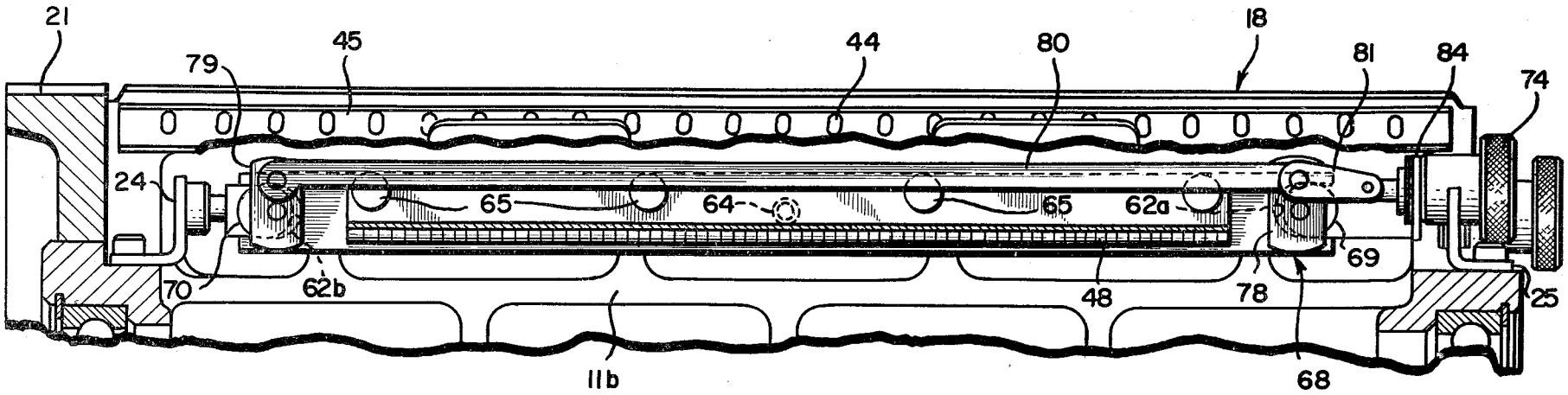
FIG. 5 is a partial section of the cylinder of FIG. 3, taken along lines 5—5, broken away to show certain details.

In accordance with the present invention the alignment of the master sheet 16 relative to the cylinder surface 15 can be easily and quickly adjusted even though it is attached to the cylinder by clamping an end thereof by fully accessible controls without removing the master from the master carrier. As exemplarily shown the head assembly 18 includes a supporting or mounting block bar 61 which is connected to the cylinder frame 11*a*, as described subsequently, for longitudinal or parallel movement with respect to the cylinder axis, and a supporting or mounting beam 62 is attached generally at its center by a pintle 64 to the mounting block 61 to permit pivotable movement thereof. The aforedescribed master head end engaging portions of the clamp assembly 18 are carried by the beam 62. Accordingly, longitudinal or angular movement of the beam 62 will be transmitted to the combination clamp plate 42 and anvil 51 and the master sheet engaging pins 44. Referring to FIGS. 2, 3 and 5, the anvil plate 51 is held on the beam 62 by a plurality of rivets 65 which also secure a wing section 48*a* of the hinge 48 to the beam 62. Another wing section 48*a* of the hinge is secured by fasteners 66 to the foot portion 46 of the clamp plate 45.

For angularly adjusting the master head end holding means of the present invention, as illustratively shown in FIGS. 5, 6, 8 and 9, there is provided an adjustor or adjustment assembly 68. For drivingly engaging the beam 62 on each side of the center pivot, a pair of cams 69, 70 are rotatably carried by the mounting block 61. Preferrably, the cam 69 takes a form having a cylindrical boss 69*a*, which is integral with a support post 69*b* but has a different center from the latter. Accordingly, rotation of the post 69*b* results in the boss 69*a* transmitting an up and down movement to an engaging follower. The post 69*a* is retained for rotational or pivotable movement in the mounting block 61 by an E-ring 69*c*, and the beam 62 is provided with a C-slot follower 62*a* to receive the cylindrical boss 69*a*. The cam 70 is identical to cam 69. The beam 62 has another C-slot follower 62*b* to engage and follow the cylindrical boss of cam 70 at the opposite end of the beam 62.

For transmitting pivotable movement to the cams 69, 70 an adjustor is provided, including a linkage assembly 72 which is operably connected to a thumb nut 74. Describing the linkage assembly in greater detail, it includes a pair of links 75, 76 rigidly secured to bosses 69, 70 respectively, at one end and pivotably connected by transversely extending posts 73*a*, 73*b* to a connecting strut 80 at the opposite end thereof. The aforementioned thumb nut 74 is operably connected to the strut 80 by a yoke 81 which slips over post 73*a* at one end and receives a pin 83 at the other end for making connection to a threaded shaft 82 that is coupled to the thumb nut 74. The nut 74 is supported in bracket 25 for slidable movement relative to the master cylinder frame and is rotatably secured by a bracket 84 to the mounting block 61. Accordingly, turning of the thumb nut 74 will move the threaded shaft 82 linearly so as to transmit, as viewed in FIG. 6, a right to left (or vice versa) movement to the yoke 81, and thereby actuate or move the connecting strut 80. The drivers or cams 69 and 70, as best shown in FIG. 5, are initially oriented so that the beam 62 is supported substantially parallel with a line coincident with the master cylinder peripheral surface and parallel to the axis of the master cylinder. That disposition of the beam 62 is also substantially perpendicular to the direction of movement of the master carrier 11 as representeed by the arrows in FIGS. 2, 3 and 7. At such time, the respective eccentrically oriented bosses of the cams 69 and 70 are positioned so that concurrent movement and rotation of the posts thereof will generate a camming action on opposite sides of the pivotable support 64 to move the respective ends of the beam 62 in opposite vertical directions. In other words, if rotation of the post for cam 69 is such as to create a camming action to lower the right hand end of beam 62 as viewed in FIG. 6, the rotation of the post for cam 70 is such as to create a camming action to raise the left hand end of beam 62. It is a specific feature of the present invention that structure is provided for supporting the beam 62 against free pivotable movement. The cams and followers on either side of the center pivot 64 provide that support. That secures the beam and the master end holding assembly 18 against movement once adjustment is made. This provides more rigidity to the master end holding mechanism and prevents back-lash which may occur otherwise. Therefore, registration is improved and accuracy in the placement of the printed image is assured.

Figure 6:
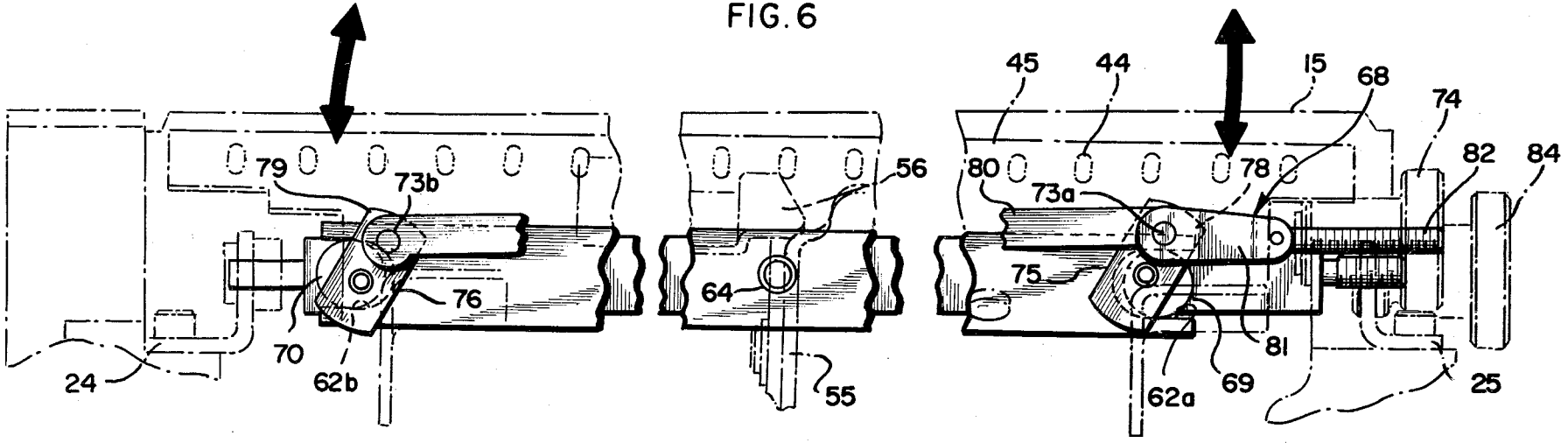
FIG. 6 is a view similar to FIG. 5 but broken out and slightly enlarged to highlight the adjusting mechanism.

To explain the effect on the master holding assembly of pivoting the beam 62 about pintle 64, shown in FIG. 6 is the position of the master holding plate 45 and pins 44 in phantom after operation of thumb nut 74 to raise the left hand side of the plate 44 and lower the right hand side. The alignment of the master, which is held at its head end by the plate 45 and its associated structure, is skewed a predetermined amount by the operation of the thumb nut so that a line of print or other image changes its alignment or disposition relative to the axis of the master cylinder and direction of rotation thereof. In other words, "downhill" or "uphill" running of printing can be corrected. The operator, by inspecting the copy that is made by the offset machine 10 as it leaves the impression cylinder 14, can make suitable adjustments turning the thumb nut 74 in order to achieve the desired alignment of the image on the copy sheets. The thumb nut 74 is located at one side or laterally of the surface of the master carrier 11. This makes the adjustor fully accessible. The master, even though of straightedge configuration, need not be disengaged from the clamp because the whole assembly is movable. That provides for simpler and more reliable adjustment of the master alignment.

The master sheet may also be moved laterally relative to the master cylinder surface 15 in a direction parallel to the cylinder axis to modify the position of the image on the copy sheet. For this purpose another adjustor including a thumb nut 84 and associated driving mechanism are provided. The thumb nut 84 is rotatably carried by bracket 25 and receives a threaded shaft 85 which is rotatably connected to mounting block 61. The thumb nut 84 cannot move linearly but, as stated, is rotatable. As it is turned, the threaded shaft 85 is withdrawn or extended to move the slidable mounting block 61 in a linear direction parallel to the axis of the cylinder 11. The opposite end of the mounting block 61 is provided with an annular projection 86 which is received for pivotable and slidable movement in a journal 88 carried by the bracket 24. Accordingly, as is clear from the above description the nut 84 can be turned to move the mounting block 61 linearly along the axis of the cylinder 11, while the thumb nut 74 can be turned to adjust the angular position of the master head end with respect to the periphery of the master cylinder 11. The latter adjustment will modify the angular alignment of the image with respect to a reference line coincident with the master cylinder surface 15 and parallel with the axis thereof. Because the beam 62 is pivotably carried on mounting block 61, axial movement of the latter will change the axial position of the printed image, while the angular adjustment of the master achieved by pivoting the beam 62 is maintained. This capability of making independent adjustments both angularly and axially of the master sheet relative to the master carrier surface, regardless of whether the master is adapted for pin bar or straight edge mounting is a desirable advantage of the present invention.

Though cylindrical bosses for cams and generally C-shaped slots for cam followers are exemplarily shown, these structures as well as others exemplarily depicted may take other forms, as those skilled in the art will understand, to provide the driving cam action and driven cam response required to pivot the beam 62. In addition, suitable provision may be made in or with such equivalent components to secure the beam 62 once the desired adjustment is achieved. Other structures exemplarily shown including the master carrier 11 may take other forms as those skilled in the art will appreciate. The master carrier may be in the form of a flat bed instead of a cylinder, for example.

Furthermore, though the adjustor 68 is exemplarily shown as a pair of cam drivers and complementary cam driven followers located on opposite sides of the center pivot of beam 62, the advantages of the present invention which permit adjustment of the master sheet to be angularly and laterally repositioned relative to the cylinder surface without removing the master sheet from the carrier surface, are still obtainable even if only one of the cam drivers and cam driven followers were utilized.

It will be understood that various changes and modifications may be made in the above described system which provide the characteristics of this invention without departing from the spirit thereof particularly as set forth in the following claims.

That which is claimed is:

1. In a duplicating machine, a carrier having a frame and a support surface overlaid by a master sheet, the carrier being cyclically operable to move the support surface and master sheet along a predetermined travel path in a predetermined direction for transferring images from the master sheet to a copy sheet, the carrier having a holding assembly for retaining an end of the master sheet, a bar mounted on the carrier frame, and a beam having opposite end portions and a central portion connected to the bar at a fixed pivot point, which beam supports the master sheet end holding assembly the improvement in drive means for pivoting the beam relative to the bar to angularly adjust the position of the master sheet relative to the carrier support surface comprising:

a first rotatable cam projecting from the bar on one side of the pivotable connection between the bar and the beam, said first cam including a first post journalled in the bar and first boss eccentrically extending from said first post, and a second rotatable cam projecting from the bar on the opposite side of said pivotable connection, said second cam including a second post journalled in the bar and a second boss eccentrically extending from said second post, a first cam follower on one end portion of the beam for operatively engaging said first cam and a second cam follower on the opposite end portion of the beam for operatively engaing said second cam, said first cam follower being maintained in continuous engagement with said first cam and said second cam follower being maintained in continuous engagement with said second cam, and an adjustor connected to said first and second cams and having a knob mounted on the carrier outboard of the master sheet travel path said adjustor including a transversely extending first link integral with said first post and a transversely extending second link integral with said second post and a third link connecting said respective first and second links for translating linear movement of said knob into rotational movement of said cams whereby the beam opposite end portions are driven in the same rotational direction.

* * * * *